United States Patent [19]

Losenno

[11] Patent Number: 4,911,185

[45] Date of Patent: Mar. 27, 1990

[54] METHOD AND SYSTEM FOR THE APPLICATION OF HAIR TREATMENT SOLUTION

[75] Inventor: Luigi G. Losenno, Minneapolis, Minn.

[73] Assignee: Gino, Ltd., Minneapolis, Minn.

[21] Appl. No.: 946,382

[22] Filed: Dec. 24, 1986

Related U.S. Application Data

[62] Division of Ser. No. 524,577, Aug. 19, 1983, Pat. No. 4,632,133.

[51] Int. Cl.[4] ..... A45D 7/00

[52] U.S. Cl. ..... 132/211

[58] Field of Search ..... 132/7, 39, 40, 41 R, 132/41 A, 9, 41 B, 41 C, 46 A, 33 R, 33 G, 36 AA, 36.2 B, 36.2, 36 R, 200–211

[56] References Cited

U.S. PATENT DOCUMENTS

| | | | |
|---|---|---|---|
| 1,442,260 | 1/1923 | Fister | 132/41 B |
| 1,718,133 | 6/1929 | Gaire | 132/36 R |
| 1,887,786 | 11/1932 | Pryor | 132/36 R |
| 2,145,539 | 1/1939 | Bottdorf | 132/41 R |
| 2,154,637 | 4/1939 | Record | 132/36.2 B |
| 2,217,729 | 10/1940 | Chancey | 132/36 R |
| 2,254,627 | 9/1941 | Schlicker | 132/36.2 B |
| 2,529,886 | 11/1950 | Semco | 132/7 |
| 2,677,380 | 5/1954 | Schoendorf | 132/36.2 B |
| 2,738,793 | 3/1956 | Voorhees | 132/33 R |
| 2,829,654 | 4/1958 | Fay | 132/41 R |
| 2,906,273 | 9/1959 | Beauregard | 132/7 |
| 2,991,790 | 7/1961 | Bonilla | 132/7 |
| 3,105,501 | 10/1963 | Scotti | 132/41 R |
| 3,241,560 | 3/1966 | Willat | 132/33 R |
| 3,465,759 | 9/1969 | Haefele | 132/7 |
| 3,759,271 | 9/1973 | Caruso | 132/40 |
| 3,766,930 | 10/1973 | Madsen et al. | 132/33 R |
| 4,005,720 | 2/1977 | Machata | 132/9 |
| 4,387,729 | 6/1983 | Abdalla | 132/33 R |
| 4,403,621 | 9/1983 | Paradise | 132/40 |
| 4,453,554 | 6/1984 | Caruso | 132/39 |
| 4,516,011 | 5/1985 | Jeffress et al. | 132/33 R |
| 4,624,272 | 11/1986 | Franzino | 132/41 A |

FOREIGN PATENT DOCUMENTS

| | | | |
|---|---|---|---|
| 510343 | 4/1952 | Belgium | 132/33 G |
| 992831 | 7/1976 | Canada | 132/33 |
| 860426 | 1/1941 | France | 132/33 G |
| 941781 | 1/1949 | France | 132/33 G |
| 312480 | 5/1929 | United Kingdom | 132/33 R |
| 399063 | 9/1933 | United Kingdom | 132/33 G |

*Primary Examiner*—Kenneth J. Dorner
*Assistant Examiner*—J. Hakomaki
*Attorney, Agent, or Firm*—Peterson, Wicks, Nemer & Kamrath

[57] ABSTRACT

A method and system for the application of hair treatment solution, such as permanent solutions, to the hair is disclosed according to the preferred embodiment of the present invention. Specifically, the present invention includes hair curlers having cylindrically shaped outside surfaces and hollow interiors. After the curler is rolled in the hair, vapor retainers may be placed around the hair rolled on the hair curler. The vapor retainer includes in its most preferred form, first and second semicircular members hinged together for defining a hair treatment solution receiving volume. Vaporized hair treatment solution may be injected into the interior of the hair curler for communication with the hair located within the vapor retainer. In its most preferred form, the curler includes a frustro-conical portion extending into the interior of the curler and having a closure formed from wedge-shaped flaps. The injector includes in its most preferred form a member for opening the flap closure of the hair curlers and further includes a source of heated, pressurized air and a member for delivering hair treatment solution into the stream of pressurized, heated air for vaporizing the hair treatment solution for introduction into the hair curler. After the hair treatment solution is allowed to set, the retainers may be removed and clips attached to the curlers for retaining the hair curlers in their rolled position in the hair. At that time, the hair may be rinsed and/or a neutralizer solution applied. Thereafter, the clips and curlers may be removed from the hair.

19 Claims, 2 Drawing Sheets

METHOD AND SYSTEM FOR THE APPLICATION OF HAIR TREATMENT SOLUTION

This is divisional of co-pending application Ser. No. 524,577 filed on Aug. 19, 1983, now U.S. Pat. No. 4,632,133 issued Dec. 30, 1986.

BACKGROUND

The present invention relates generally to methods and systems for the application of hair treatment solution to hair and more specifically to a method and system for the application of vaporized hair treatment solution to hair.

Prior to the present invention, hair treatment solutions such as permanent solutions were applied to the hair in liquid form. This resulted in excessive waste of the solution, in possible damage to the hair, and in possible irritation to the patron's scalp. The use of liquid solution also required considerable time for application, required the use of harsh chemicals which were hard on the hair, and had other, like, and different disadvantages and limitations. Further, the use of steam to restore the hair and prepare the hair for hair treatment solution was recognized at least by the present inventor as disclosed in U.S. Pat. No. 4,205,692.

Thus, a need has arisen for a method and system of applying hair treatment solution to hair which is less time consuming both to the patron and the salon operator, which maximizes the use of hair treatment solution, which allows the use of gentler hair treatment solutions, and is otherwise advantageous.

SUMMARY

The present invention solves these and other needs in applying hair treatment solution to hair by providing a system including hair curlers having an interior and an exterior surface. The hair of the patron may be wrapped around the exterior surface of the hair curlers. Vaporized hair treatment solution may be introduced into the interior of the hair curlers and may be released from the interior of the hair curler through the exterior surface of the hair curler. The vaporized hair treatment solution is retained within a solution volume in which the hair curler and the hair wrapped thereon is located.

The present invention further solves these and other needs in applying hair treatment solution by providing, in the preferred embodiment, a method for applying hair treatment solution including the introduction of vaporized hair treatment solution into a hair treatment solution volume in which a curler an hair wrapped thereon is located.

Thus, it is an object of the present invention to provide a novel hair treatment solution application system.

Further, it is an object of the present invention to provide a novel hair treatment solution application method.

Additionally, it is an object of the present invention to provide a novel hair curler having a hollow interior and an exterior surface for wrapping the hair therearound.

It is further an object of the present invention to provide such a novel system and method wherein vaporized hair treatment solution may be introduced into a solution volume where the hair curler and hair wrapped thereon is located.

It is further an object of the present invention to provide such a novel system, method, and/or curler including means for injecting vaporized hair treatment solution into a hollow interior of the hair curler.

It is further an object of the present invention to provide such a novel system including a unique hair curler including a hollow interior and an exterior surface for wrapping hair thereon.

These and further objects and advantages of the present invention will become clearer in light of the following detailed description of an illustrative embodiment of this invention described in connection with the drawings.

DESCRIPTION OF THE DRAWINGS

The illustrative embodiment may bet be described by reference to the accompanying drawings where.

Figures 1, 4, 5:
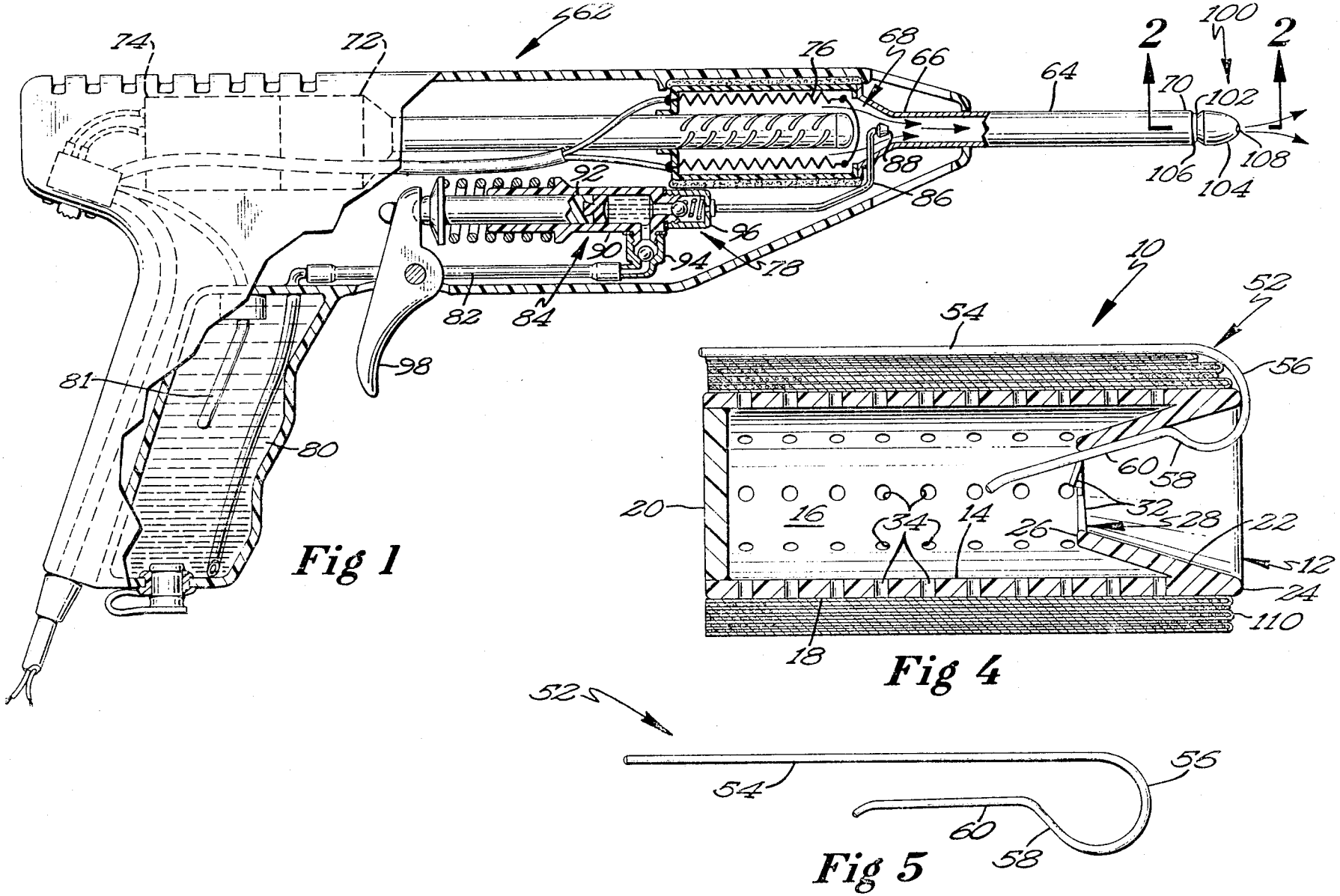
FIG. 1 shows a cross-sectional view of a member for injecting vaporized hair treatment solution into a solution volume of a hair treatment solution application system according to the teachings of the present invention.
FIG. 4 shows a cross-sectional view of components of the hair treatment solution application system in use according to the teachings of the present invention.
FIG. 5 shows a side view of a hair curler clip member of the hair treatment solution application system according to the teachings of the present invention.
Figure 6:
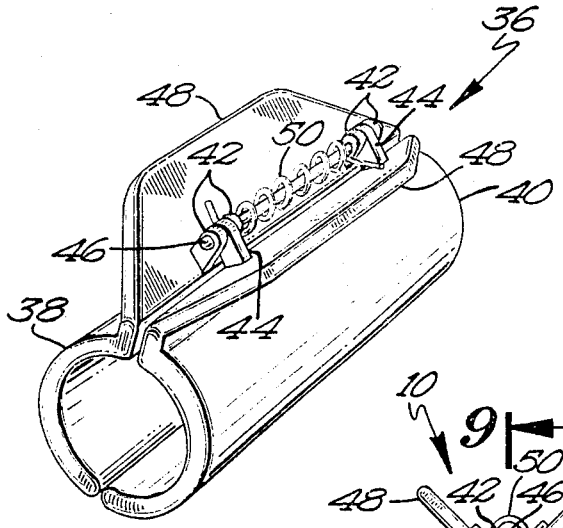
FIG. 6 shows a perspective view of a retaining member of the hair treatment solution application system according to the teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms, "top", "bottom", "first", "second", "inside", "outside", "exterior", "interior", and similar terms are used herein, it should be understood that these terms have reference only to the structure shown in the drawings as it would appear to a person viewing the drawings and are utilized only to facilitate describing the invention.

DESCRIPTION

A hair treatment solution application system according to the teachings of the present invention is shown in the drawings and designated 10. System 10 includes in its most preferred form hair curlers 12 for receiving heated, vaporized hair treatment solution in its interior and for releasing the heated solution outwardly therefrom through the hair wrapped therearound. In the preferred embodiment, curlers 12 include a cylindrical shaped body member 14 having an interior 16 and an outside or exterior surface 18. Curler 12 includes a circular end piece 20 for generally closing off or generally preventing solution communication through the first end of body member 14.

Curler 12 further includes a frustro-conical end piece 22 having the base portion attached to the second end 24 of boy member 14 and extending into interior 16 of member 14. Interior end 26 of end piece 22 has a diameter which is less than the diameter of end 24 of body member 14. The diameter of body member 14 will vary according to the type of curl desired; however, the diameter of end 26 of end piece 22 and the length of end piece 22 will be the same for every diameter of body member 14. Thus, the slope of end piece 22 will also vary according to the diameter of body member 14 in it most preferred form.

End 26 of end piece 22 is selectively closeable by a closure 28 shown in its preferred form as a membrane having crossed slits 30 formed therein to form wedge shaped flaps 32 therebetween. Thus, flaps 32 can be pushed inwardly allowing communication with interior 16 of body member 14 and have a normal position in the plane of end 26 to thus abut with each other and provide a closure for end 26.

Curlers 12 further include members 34 for allowing release of hair treatment solution from interior 16 of body member 14 through outside surface 18. In the preferred embodiment of the present invention, members 34 are shown as a series of apertures formed through body member 14 in radially spaced relations. It can ten be appreciated that the number, size, and location of apertures 34 control the rate and distribution of hair treatment solution to the hair. In the preferred embodiment, curlers 12 are formed of a relatively rigid material which resists bending or breaking under high temperatures and in its most preferred form are formed of rigid plastic.

System 10 further includes in the preferred embodiment members 36 for retaining hair in a wrapped condition around curlers 12 and for retaining hair treatment solution in a volume defined by curler 12 and the hair wrapped therearound. Members 36 include first and second generally semicircular members 38 and 40 which are hinged together adjacent their first ends. In its most preferred form, member 38 includes two U-shaped members 42 for receiving therein two hinge members 44 of member 40. A hinge pin 46 extends through members 42 and 44 for pivotally mounting members 38 and 40. Member 36 further includes handle portions 48 which extend from the hinged, first ends of members 38 and 40. Members 38 and 40 are biased in a closed position with their second free ends touching to generally form a generally cylindrical shape by spring 50 shown in its most preferred form as a torsion spring located around hinge pin 46 and having its opposite ends abutting with handle portions 48 of members 38 and 40, respectively. Members 36 have a length equal to the length of curlers 12 and a diameter generally equal to the diameter of curler 12 and the hair wrapped thereon.

Member 38 and 40 can be manufactured in various diameters to match the diameter of curlers 12 as in the preferred embodiment or can be manufactured in a single diameter with suitable inserts to reduce the diameter to make the various diameters of curlers 12. It can then be appreciated that in its most preferred form, members 36 cooperate with curler 12 to form the hair treatment solution receiving volume having a generally cylindrical shape with the cylindrical side walls being formed and defined by members 38 an 40 of member 36 and with the end walls being formed and defined by end piece 20 and end piece 22 and closure 28 of curlers 12.

System 10 further includes a curler clip 52. Clip 52 in its most preferred form is U-shaped and includes a first, straight, elongated leg portion 54 having a length generally equal to the length of body member 14 of curler 12. Attached to one end of leg portion 54 is a first end of an enlarged loop 56. The second end of loop 56 is attached to a generally, straight portion 58 extending at an angle to leg portion 54. The other end of portion 58 is attached to a second, straight, elongated leg portion 60 which is generally parallel to leg portion 54 and having a length which is less than body member 14 of curler 12 and leg portion 54. In its most preferred form, the free end of leg portion 60 is bent up at its end to present an entry surface for entering closure 28 through slits 30 without damaging flaps 32.

After hair has been wrapped around curler 12, clip 52 can be inserted such that leg portion 60 extends through one of the slits 30 of closure 28 of end 26 of end piece 22 until loop 56 abuts with end 24 of body member 14. Thus, leg portion 54 extends generally parallel to outside surface 18 of curler 12 with the hair captured therebetween. Inclined portion 58 insures that clip 52 engages with end piece 22 for holding clip 52 on and in curler 12 and insuring that clip 52 does not fall therefrom even under the force of the hair wrapped therearound. In addition to allowing the construction of clip 52 including inclined portion 58 for the advantages gained thereby, loop 56 acts as a handle in allowing ease of insertion and removal of clip 52 in curlers 12.

System 10 further includes an injector 62 for injecting vaporized hair treatment solution into curlers 12. In its most preferred form, injector 62 includes a conduit 64 having a first end 66 in fluid communication with a source 68 of pressurized, heated air and having a second exhaust end 70. Source 68 includes a fan 72 driven by a motor 74 for pulling air from the environment and supplying it under pressure into end 66 of conduit 64. Source 68 further includes a heating device 76 such as coiled heat resistor for heating the pressurized air supplied by fan 72 to and through conduit 64.

Injector 62 further includes in the preferred embodiment member 78 for delivering hair treatment solution into the heated pressurized air flowing through conduit 64 and its most preferred form, for delivering heated hair treatment solution into the heated pressurized air flowing through conduit 64. In the preferred embodiment of the present invention, member 78 includes a source 80 of hair treatment solution such as a bottle, container, or reservoir for holding hair treatment solution. In its most preferred form, source 80 further includes a solution heater 81 or other suitable heat source for preheating the hair treatment solution located within source 80. Source 80 is in fluid communication through a conduit 82 to a solution pump 84 for injecting solution through a conduit 86 in fluid communication with a nozzle 88 located in the interior of conduit 64. In its most preferred form, pump 84 includes a cylinder 90 which reciprocally receives a piston 92. Pump 84 further includes a check valve 94 for allowing fluid communication from cylinder 90 into conduit 86 but prevents fluid communication from conduit 86 into cylinder 90. A check valve 96 is further provided for allowing fluid communication from conduit 82 into cylinder 90 but prevents fluid communication from cylinder 90 into conduit 82. In its preferred form, injector 62 is in the shape of a pistol or gun and piston 92 is actuable by a trigger 98. In its most preferred form, source 80 is located in the hand grip portion of the pistol shaped injector 62.

Injector 62 further includes in the preferred embodiment of the present invention, an introduction member 100 for opening closure 28 of hair curlers 12 allowing introduction of hair treatment solution into curlers 12 but generally preventing escape of the hair treatment solution through end 26 around member 100. In its most preferred form, member 100 is formed on end 70 of conduit 64 and includes a depression 102 for dividing member 100 into a first, generally spherical portion 104 and a second, connection portion 106 connected to end 70 of conduit 64. Thus, member 100 may be inserted into frusto-conical end piece 22 of hair curlers 12 until spherical portion 104 engages with closure 28. Due to the spherical shape of portion 104, no abrupt edges are presented to closure 28 to thereby puncture or otherwise damage closure 28. Upon further insertion of member 100, portion 104 acts in a cam-like manner with flaps 32 of closure 28 riding upon the spherical shape of portion 104. Member 100 is then further inserted until end 26 of curler 12 ridges into depression 102 of member 100. It can then be appreciated that a sealing engagement results between end 26 of curler 12 and member 100 of injector 62 to prevent vaporized hair treatment solution and/or heated, pressurized air from leaking around member 100 through end 26 of curler 12.

In the preferred embodiment of the present invention, member 100 includes an internal passageway 108 for fluid communication with conduit 64. Furthermore, in its most preferred embodiment, passageway 108 includes an air flow director 112 for providing a turbulent, air stream mixing to insure that the hair treatment solution is thoroughly mixed in the heated, pressurized air stream to insure that the hair treatment solution is suspended in the air stream as a mist and/or vaporized in the air stream. In its most preferred form, director 112 includes three fixed, directional blades or vanes 114 having their internal ends connected to a central post 116 and their outer periphery connected to a ring 118. Vanes 114 have a partial spiral between post 116 and ring 118 to have a fan blade shape for causing the hair treatment solution and the air stream to be turbulently mixed as it flows therearound.

Figure 7:
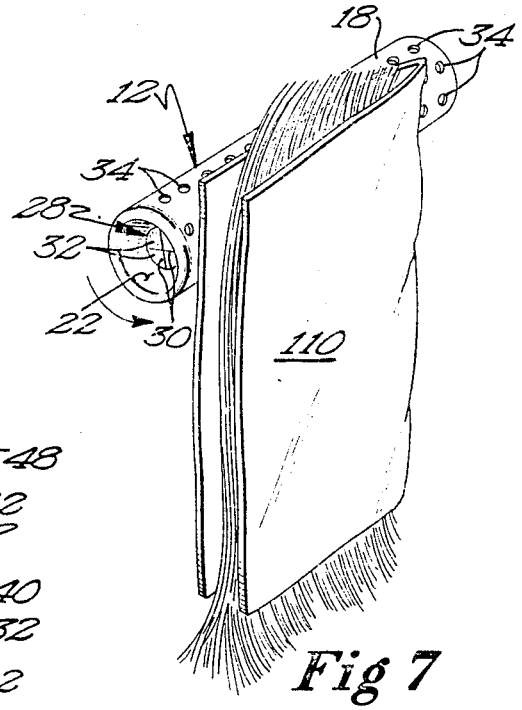
FIG. 7 shows the step of sandwiching the ends of the hair between a folded hand paper in preparation for rolling on a hair curler according to the teachings of the present invention.

Now that the basic structure and components of system 10 according to the preferred embodiment of the present invention have been explained, the subtle features and operation of system 10 can now be set forth and appreciated. First, suitable hand paper or tissue 110 is obtained for rolling with the hair. Specifically, a section of hair is arranged for rolling around curler 12. Hand paper 110 is then placed around the nd of the hair such that the hair is sandwiched between the hand paper as best seen in FIG. 7.

In its most preferred form, hand paper 110 is saturated with hair treatment solution, such as permanent solution. This is advantageous over nonsaturated tissue because the saturated hand paper 110 keeps the hair from drying or becoming brittle. Furthermore, the use of saturated hand paper 110 opens the cuticle of the hair and breaks the bonds of the hair for preparing the hair for quicker hair treatment.

Figure 8:
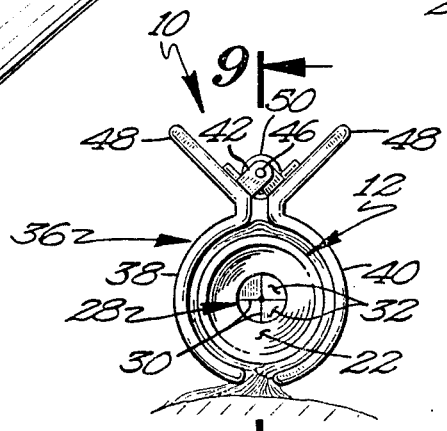
FIG. 8 shows an end view of the components of the hair treatment application system in use according to the teachings of the present invention.
Figure 9:
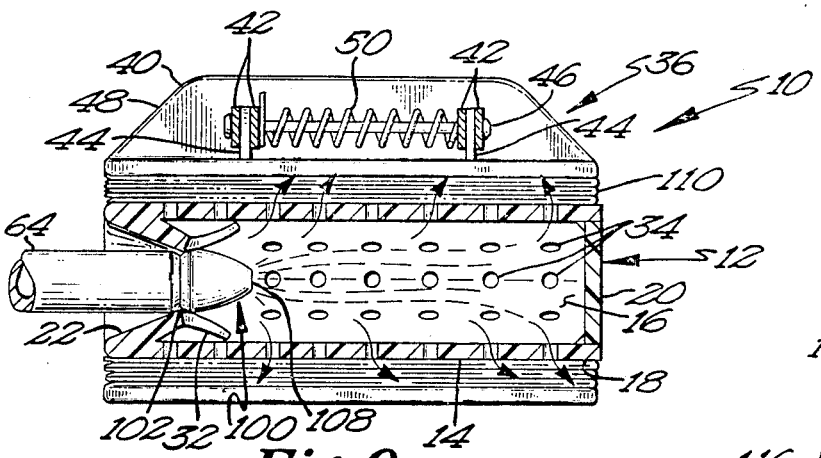
FIG. 9 shows a cross-sectional view of the components of FIG. 8 according to section line 9—9 of FIG. 8.
Figure 3:
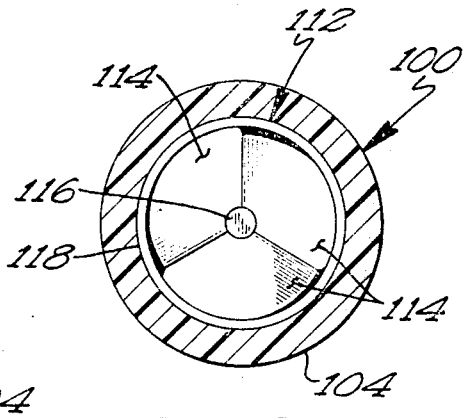
FIG. 3 shows a cross-sectional view of the member of FIG. 1 according to section line 3—3 of FIG. 2.
Figure 2:
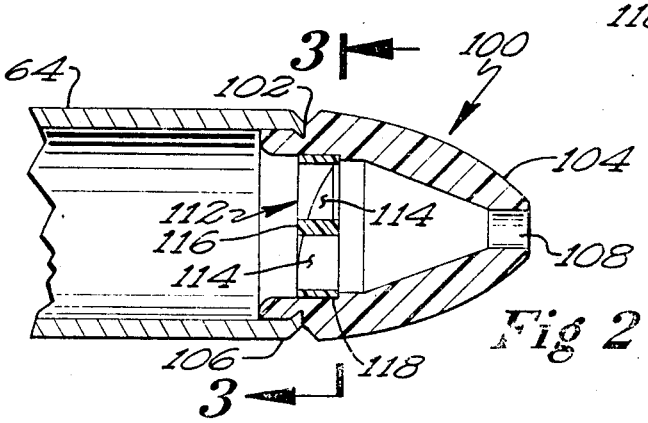
FIG. 2 shows a cross-sectional view of the member of FIG. 1 according to section line 2—2 of FIG. 1.

At that time, curler 12 may be placed on one side of hand paper 110 adjacent the ends of the hair and the hair may be rolled until curler 12 is adjacent to the scalp of the patron. At that time, retainer 36 may be obtained and positioned around curler 12. Specifically, handle portions 48 are grasped and members 38 and 40 are opened against the bias of spring 50 such that members 38 and 40 may be placed on opposite sides of curler 12 with hair rolled thereon. At that time, members 38 and 40 are allowed to close under the bias of spring 50 such that the free ends of members 38 and 40 abut against opposite sides of the hair adjacent to the scalp as best seen in FIGS. 8 and 9. Therefore, retainer 36 retains curlers 12 and the hair rolled thereon in a very tight condition.

Prior to the present invention hair curlers or rods included rubber bands or the like which were extended between the ends of the curlers. However, when hair treatment solution was added to the hair, the hair expanded and the rubber band became tighter and rested upon the hair. With the rubber band tight against the hair, the band can break the hair as well as provide uneven hair treatment format on the hair. To alleviate some of these problems, prior to the present invention, picks were placed under the rubbers bands to prevent the bands from touching the hair. However, such picks placed an uneven pressure on the hair and resulted in uneven hair treatment format on the hair. Furthermore, the placement of such picks under the rubber band was very time consuming in their placement and removal.

Retaining members 36 of the present invention solve these problems of prior hair curlers or rods by eliminating such bands as were utilized in prior rods and curlers. Furthermore, retaining member 36 provide even pressure to the hair resulting in even hair treatment format on the hair. Further, retaining members 36 can be easily and rapidly placed around curlers 12 and the hair rolled thereon. Therefore, curlers 12 and retaining members 36 according to the teachings of the present invention are clearly advantageous over prior curlers including rubber bands as utilized in the prior art.

Next, spherical portion 104 of member 100 may be inserted through closure 28 as hereinbefore described and heated, pressurized air can be injected into interior 16 of curler 12 as best seen in FIG. 9. Further, rigger 98 may be actuated forcing hair treatment solution from reservoir 80 into conduit 64. In conduit 64, solution becomes suspended in mist form and/or is vaporized in the air stream for injection with the heated pressurized air into interior 16 of curler 12. It can then be appreciated that heater 81 preheating the hair treatment solution in reservoir 80 accelerates the rate and degree of vaporization of the solution in the heated, pressurized air stream. The vaporized hair treatment solution and air can be injected into interior 16 of curler 12 and can travel until it hits end piece 20 at which time the vaporized hair treatment solution will fill the entire interior 16 of curler 12 and begin passing through apertures 34 and into the hair rolled around outside surface 18 of curler 12. Thus, the temperature will be relatively constant throughout the length of curlers 12. Furthermore, due to the frustro-conical shape of end piece 22, vaporized hair treatment solution and air are able to reach end 24 of curler 12 between frustro-conical end piece 22 and body member 14.

It can then be appreciated that retainer 36 retains the vaporized hair treatment solution released through apertures 34 of curler 12 within its internal diameter, i.e., within the hair rolled on curler 12 and the interior 16 of curler 12 or in other words the hair treatment solution volume. Any excess hair treatment solution will remain in interior 16 of curler 12 and does not collect upon or run from the scalp of the patron. Furthermore, retainer 36 protects the scalp of the patron from the heat of the vaporized treatment solution and heated air introduced into interior 16 of curler 12.

After the desired amount of hair treatment solution is injected into interior 1 of curler 22, member 100 can be retracted from closure 28 such that flaps 32 return to their original closed position, as best seen in FIG. 8. It can then be appreciated that closure 28 thus seals end 26 to prevent the vaporized hair treatment solution from communicating through or exiting through end 26.

It should then be appreciated that in its most preferred form, the use of air into which the hair treatment solution is suspended or vaporized provides several advantages over vaporized or misted hair treatment solution. First, prior to the introduction of the hair treatment solution, the pressurized air injected into interior 16 of curler 12 prepares the hair for treatment. Specifically, the heated air opens the cuticle of the hair and allows better penetration of the hair treatment solution into the hair. Next, the pressurized air stream forces the hair treatment solution suspended or vaporized in the air stream out of interior 16 of curler 12 after it has been injected therein through apertures 34 to and through the hair wrapped around curler 12. Likewise, without the use of air, misted or vaporized hair treatment solution has a tendency to collect in liquid form on the end of injection 62 and drip therefrom. Such drops could then fall from the end of injector 62 on the scalp of the patron or other locations. Thus, the use of heated, pressurized air with these and other advantages is preferred in the application of hair treatment solution.

Prior to the present invention, treatment solution was applied to hair in a liquid form. Thus, great amounts of treatment solution would run from the hair down the scalp of the user. Excess hair treatment solution was then blotted using cottonballs, towels, or the like. It can then be appreciated that this resulted in the very wasteful use of the treatment solution as well as increasing overhead costs and work station clutter from the blotting material. Additionally, this excess treatment solution irritated or further irritated the scalp of the patron, as well as the fingers of the stylist, possibly resulting in infection. For example, if the patron has any rashes, sores, or the like located in the scalp or adjacent to the scalp, the excess hair treatment solution could run over these areas and possibly cause irritation. Further, due to the harsh nature of the treatment solutions and the frequency of application, the hands of the stylist are especially prone to irritation. Furthermore, certain patrons and stylists are allergic to the hair treatment solutions.

System 10 according to the teaching of the present invention thus results in several major advantages over prior solution application techniques. For example, since the hair treatment solution is retained by members 36 within the solution retaining volume, system 10 according to the teachings of the present invention allows the application of hair treatment solution to patrons having sores or other irrititations in or adjacent to their scalps and to other persons who may not otherwise have been allowed to receive the treatment solution, such as persons allergic to the hair treatment solution. Furthermore, since the stylist has greatly diminished contact with the hair treatment solution, the hands of the stylist are subject to littleor no irritation. Additionally, no waste of the hair treatment solution exists.

Further, in liquid form, harsher chemicals were required to break the bond of the hair to allow hair treatment. Utilizing the present invention, a gentler, less harsh hair treatment solution may be utilized. Specifically, utilizing vaporized hair treatment solution, the bonds of the hair break down better allowing the hair treatment solution to penetrate better in the hair. Further, the resulting steam of the hair treatment solution repairs damage to the hair. Likewise, the hair treatment solution is faster acting in a vaporized form rather than as a liquid and requires less total application time. Furthermore, hair treatment solution applied according to the teachings of the present invention rinses better from the hair leaving less residue, thus reducing the undesireable odor associated with hair treatment solutions such as permanent solutions. Thus, utilizing system 10 according to the teachings of the present invention where vaporized hair treatment solution is utilized is advantageous and produces advantageous results.

After the hair treatment solution has been allowed sufficient time to act on the hair, retainers 36 may then be removed. At that time, clips 52 may be inserted as described hereinbefore and as best seen in FIG. 4. After clips 52 have been inserted, the hair can be rinsed with water and/or a neutralizer solution can be applied. After the final rinse of the hair, clips 52 and curlers 12 can be removed from the hair.

Now that the basic teachings of the present invention have been explained, many extensions and variations will be obvious to one having ordinary skill in the art. For example, although a total system 10 utilizing curlers 12, retainers 36, clips 52, and injector 62 described in their preferred forms is preferred, curlers 12, retainers 36, clips 52, and injectors 62 may be utilized in a hair treatment solution system independently, together, and/or with other hair treatment system components.

Also, although curlers 12, retainers 36, clips 52, and injector 62 as described in their preferred forms are believed to be particularly advantageous, system 10 according to the teachings of the present invention may utilize other constructions, shapes, and forms of curlers, retainers, clips, or injectors.

Further, the preferred construction of injector 62 as set forth is believed to be advantageous; however, injectors of other types and constructions and/or other members for introducing vaporized hair treatment solution into curlers may be provided according to the teachings of the present invention.

Additionally, although curlers 1 are particularly advantageous for use in receiving treatment solution in its interior for release outwardly through the hair wrapped therearound, curlers 12 can be utilized in a manner in the prior art where treatment solution such as in liquid form is applied to the exterior of the curler and the hair wrapped therearound with suitable retaining members such as clips 52 to avoid the disadvantages of prior curlers including the disadvantages resulting from the use of rubber bands or the like as discussed hereinbefore.

Thus, since the invention disclosed herein ma be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Method for applying hair treatment solution to hair of a patron comprising the steps of:

(a) providing a hair curler having an exterior surface, a hollow interior, and members for allowing release of the hair treatment solution from the hollow interior of the hair curler through the exterior surface of the hair curler;

(b) placing the exterior surface of the hair curler against the hair and rolling the hair around the exterior surface of the hair curler;

(c) placing a retaining member around the hair curler for retaining the hair in a rolled condition on the exterior surface of the hair curler and for creating a solution retaining volume having a size and shape complementary to the hair curler and the hair rolled thereon such that the solution retaining volume substantially encloses the hair curler and the hair rolled thereon;

(d) introducing vaporized hair treatment solution into the hollow interior of the hair curler located within the solution retaining volume for retention within the solution retaining volume;

(e) removing the retaining member; and (f) unrolling the hair from the exterior surface of the hair curler and removing the hair curler from the hair.

2. The hair treatment solution application method of claim 6 wherein the step of providing a head paper comprises the step of providing a hand paper saturated with hair treatment solution for pre-treatment a preparation of the hair prior to the introduction of the vaporized hair treatment solution into the solution retaining volume.

3. The hair treatment solution application method of claim 1 wherein the step of providing a hair curler having an exterior surface comprises the step of providing a hair curler having a cylindrical shaped exterior surface, a hollow interior, and members for allowing the release of hair treatment solution from the hollow interior of the hair curler and through the exterior surface of the hair curler and the hair rolled thereon; and wherein the step of placing a retaining member comprises the step of placing a retaining member having a diameter which is equal to and matches the diameter of the cylindrical shaped exterior surface of the curler and the hair rolled around the hair curler for retaining the hair in a rolled condition on the exterior surface of the hair curler and for creating a solution retaining volume having a generally cylindrical shape and a size such that it substantially encloses within said volume the hair curler and the hair rolled thereon.

4. The hair treatment solution application method of claim 1 further comprising after the step of removing the retaining member the steps of:

(1) placing a hair clip member on the hair curler for retaining the hair in a rolled condition on the exterior surface of the hair curler;

(2) rinsing the hair; and (3) removing the hair clip member.

5. The hair treatment solution application method of claim 1 wherein the step of introducing vaporized hair treatment solution comprises the step of introducing pressurized, heated air including vaporized hair treatment solution suspended there into the solution retaining volume.

6. The hair treatment solution application method of claim 1 further comprising the steps of:

(a) providing a hand paper;

(b) folding the hand paper adjacent to the ends of the hair for sandwiching the hair between the hand paper, with the step of placing the hand curler comprising the step of placing the hand curler against a surface of the hand paper and rolling the hand paper and the hair around the exterior surface of the hair curler, and wherein the step of removing the hair curler from the hair further comprises the step of removing the hand paper from the hair;

7. The hair treatment solution application method of claim 1 wherein the step of introducing vaporized hair treatment solution into the solution retaining volume for retention therein comprises the step of introducing pressurized, vaporized hair treatment solution into the solution retaining volume for retention therein.

8. The hair treatment solution application method of claim 7 wherein the step of introducing pressurized, vaporized hair treatment solution into the solution retaining volume for retention therein comprises the steps of:

(a) providing a stream of pressurized, heated air; and (b) delivering the hair treatment solution into the stream of pressurized, heated air for vaporizing the hair treatment solution in the pressurized, heated air.

9. The hair treatment solution application method of claim 8 further comprising the step of:

(c) directing the stream of pressurized, heated air for providing a turbulent, air stream mixing to insure that the hair treatment solution is suspended in the stream of pressurized, heated air.

10. The hair treatment solution application method of claim 1 wherein the step of introducing vaporized hair treatment solution into the hollow interior of the hair curler comprises the step of introducing vaporized hair treatment solution into the hollow interior of the hair curler through an introduction port; and wherein the hair treatment solution application method further comprises after the step of introducing the vaporized hair treatment solution the step of preventing release of the vaporized hair treatment solution through the introduction port of the hair curler.

11. The hair treatment solution application method of claim 10 wherein the step of preventing release of the vaporized hair treatment solution through the introduction port of the hair curler comprises the step of providing a closure for the introduction port of the hair curler formed from a membrane closing the introduction port, with the membrane having crossed slits formed therein to form wedge shaped flaps therebetween, wherein the flaps can be pushed inwardly allowing introduction of the hair treatment solution into the interior of the hair curlers and in their normal, unpushed positions, the flaps abut with each other and provide a closure for the introduction port.

12. The hair treatment solution application method of claim 3 wherein the step of placing a retaining member comprises the steps of:

(a) providing a retaining member including a first end and second end;

(b) separating the first end of the retaining member from the second end of the retaining member for allowing placement of the retaining member on the hair curler with the hair curler within the retaining member; and (c) abutting the first end of the retaining member with the second end of the retaining member on opposite sides of the hair adjacent to the scalp of the patron to capture the hair curler and the hair rolled thereon within the retaining member solution retaining volume.

13. The hair treatment solution application method of claim 12 wherein the step of providing a retaining member comprises the step of providing first and second generally semicircular members, with the first semicircular member including a third end and the first end of the retaining member and the second semicircular member including a fourth end and the second end of the retaining member, with the first and second semicircular members hingedly mounted together by the third end of the first semicircular member and by the fourth end of the second semicircular member, and with the semicircular members being biased together such that the first end of the first semicircular member abuts with the second end of the second semicircular member.

14. The hair treatment solution application method of claim 4 wherein the step of placing a hair clip member on the hair curler comprises the step of placing a hair clip member having an elongated leg portion held generally parallel to the hair curler with the rolled hair captured between the hair curler and the elongated leg portion for retaining the hair in a rolled condition on the exterior surface of the hair curler.

15. Method for applying hair treatment solution to hair of a patron comprising the steps of:

(a) providing a hair curler having an exterior surface;

(b) placing the exterior surface of the hair curler against the hair and rolling the hair around the exterior surface of the hair curler;

(c) placing a retaining member around the hair curler for retaining the hair in a rolled condition on the exterior surface of the hair curler and for creating a solution retaining volume having a size and shape complementary to the hair curler and the hair rolled thereon such that the solution retaining volume encloses the hair curler and the hair rolled thereon;

(d) providing a stream of pressurized, heated air;

(e) introducing the stream of pressurized, heated air into the solution retaining volume;

(f) delivering the hair treatment solution into the stream of pressurized, heated air for suspending the hair treatment solution in the stream of pressurized, heated air and for retaining the hair treatment solution within the solution retaining volume;

(g) removing the retaining member; and (h) unrolling the hair from the exterior surface of the hair curler and removing the hair curler from the hair.

16. The hair treatment solution application method of claim 15 further comprising the step of directing the stream of pressurized, heated air for providing a turbulent, air stream mixing to insure that the hair treatment solution is suspended in the stream of pressurized, heated air.

17. The hair treatment solution application method of claim 16 further comprising the step of preheating the hair treatment solution prior to its delivery to the stream of pressurized heated air.

18. The hair treatment solution application method of claim 16 wherein the step of directing the stream of pressurized, heated air comprises the step of placing spiral blades in the stream of pressurized, heated air.

19. The hair treatment solution application method of claim 15 wherein the step of delivering the hair treatment solution into the stream of pressurized, heated air comprises the step of pumping the hair treatment solution through a nozzle located in the stream of pressurized, heated air.

* * * * *

UNITED STATES PATENT OFFICE

CERTIFICATE OF CORRECTION

Patent No. 4,911,185 Dated March 27, 1990

Inventor(s) Luigi G. Losenno

It is certified that error appears in the above-identified patent and that said Letters Patent is hereby corrected as shown below:

Column 1, line 51, cancel "an" and substitute --and--.
Column 2, line 14, cancel "bet" and substitute --best--.
Column 2, line 39, after "treatment" insert --solution--.
Column 3, line 38, cancel "ten" and substitute --then--.
Column 4, line 10, cancel "an" and substitute --and--.
Column 5, line 63, cancel "nd" and substitute -- end--.
Column 6, line 50, cancel "rigger" and substitute --trigger--.
Column 7, line 15, cancel "1" and substitute --16--.
Column 7, line 61, cancel "teaching" and substitute --teachings--.
Column 8, line 6, cancel "littleor" and substitute --little or--.
Column 8, line 56, cancel "1" and substitute --12--.
Column 8, line 67, cancel "ma" and substitute --may--.
Column 9, line 37, cancel "head" and substitute --hand--.
Column 9, line 39, cancel "a".
Column 9, line 54, before "curler" insert --hair--.
Column 10, line 5, cancel "there" and substitute --therein--.
Column 10, line 18, cancel ";" and substitute --.--.
Column 11, line 2, after "and" insert --a--.

Signed and Sealed this

Twenty-sixth Day of March, 1991

*Attest:*

HARRY F. MANBECK, JR.

*Attesting Officer* *Commissioner of Patents and Trademarks*